United States Patent [19]

Bujalski et al.

[11] Patent Number: 4,673,930

[45] Date of Patent: Jun. 16, 1987

[54] IMPROVED MEMORY CONTROL FOR A SCANNING CRT VISUAL DISPLAY SYSTEM

[75] Inventors: Joseph Bujalski, Roselle; John R. Welk, Addison, both of Ill.

[73] Assignee: Motorola, Inc., Schaumburg, Ill.

[21] Appl. No.: 699,762

[22] Filed: Feb. 8, 1985

[51] Int. Cl.[4] ..... G09G 1/16

[52] U.S. Cl. ..... 340/703; 340/721; 340/750

[58] Field of Search ..... 340/703, 721, 750, 731, 340/745

[56] References Cited

U.S. PATENT DOCUMENTS

| | | | |
|---|---|---|---|
| 3,603,962 | 9/1971 | Lechner | 340/703 |
| 4,200,867 | 4/1980 | Hill | 340/703 |
| 4,217,577 | 8/1980 | Roe et al. | 340/703 |
| 4,232,311 | 11/1980 | Agneta | 340/703 |
| 4,342,029 | 7/1982 | Hofmanis et al. | 340/721 |
| 4,434,420 | 2/1984 | Bujalski | 340/724 |
| 4,563,677 | 1/1986 | Seiler | 340/731 |
| 4,581,611 | 4/1986 | Yang et al. | 340/750 |

OTHER PUBLICATIONS

NEC Graphics Display Controller brochure for PD7220/GDC, 1982.

LogicPac ® Instruction Manual, Aug. 83, Rev B.

"Achieving a Colored Image Display from Images Lacking Specified Color Content" by Giddings and Williams, IBM Technical Disclosure Bulletin, vol. 18, No. 7, Dec. 1975.

*Primary Examiner*—Marshall M. Curtis

*Attorney, Agent, or Firm*—Robert J. Crawford; Phillip H. Melamed

[57] ABSTRACT

A scanning CRT graphics video display system is disclosed in which a graphics display controller reads formatted information signals into a refresh memory in a read-modify-wire mode and reads the stored information out of the refresh memory in a display mode. During the display mode the information in the memory is provided on a common data bus for sequential reading into four different shift registers having different bit capacities with the different bit capacities effectively implementing predetermined delays such that the shift registers will properly simultaneously read out the information that was sequentially loaded into the shift registers. A programmable logic sequencer provides address select signals in addition to address signals provided by the graphics display controller so as to address four different memory planes in the refresh memory, and the address select signals are also utilized to sequentially enable the loading of the four shift registers. The logic sequencer provides a clock timing signal to the controller for controlling the frequency of operation thereof. During the display mode the clock frequency is provided at a first frequency while during the read-modify-write mode, which occurs during video blanking, the sequencer provides a substantially higher frequency clock signal to the controller to implement rapid reading of information into the refresh memory.

20 Claims, 5 Drawing Figures

82S105 PIN No'S IN ( )

DOT CLK APPLIED PIN (1)

| STATE No. | INPUT VARIABLES | | | | | | | | | | | | | | | PRESENT STATE | | | | | | NEXT STATE | | | | | | OUTPUT FUNCTIONS | | | | | | | |
|---|---|---|---|---|---|---|---|---|---|---|---|---|---|---|---|---|---|---|---|---|---|---|---|---|---|---|---|---|---|---|---|---|---|---|---|
| | | | | | | | | | | | | | | ALE (7) | DBIN (8) | BLK (9) | E | D | C | B | A | E | D | C | B | A | 2xWCLK (10) | W (11) | S/L (12 | CSA (13) | RAS (15) | D (16) | C (17) | ALCH (18) |
| | 15 | 14 | 13 | 12 | 11 | 10 | 9 | 8 | 7 | 6 | 5 | 4 | 3 | 2 | 1 | 0 | 5 | 4 | 3 | 2 | 1 | 0 | 5 | 4 | 3 | 2 | 1 | 0 | 7 | 6 | 5 | 4 | 3 | 2 | 1 | 0 |
| 0 | | | | | | | | | | | | | | | | | | | | | | 0 | | | | | | 1 | | | | | | | | |
| 1 | | | | | | | | | | | | | | | | | | | | | | 1 | | | | | | 0 | | | | | | | | |
| 2 | | | | | | | | | | | | | | | | | | | | | 0 | 1 | | | | | 1 | | | 1 | | | | | | |
| 3 | | | | | | | | | | | | | | | | | | | | | 1 | 1 | | | | | 0 | | | | | | | | | |
| 4 | | | | | | | | | | | | | | | | | | | | 0 | 1 | 1 | | | | 1 | | | 0 | | | | | | 1 | |
| 5 | | | | | | | | | | | | | | | | | | | | 1 | 1 | 1 | | | | 0 | | | 1 | | | | | | 0 | |
| 6 | | | | | | | | | | | | | | | | | | | 0 | 1 | 1 | 1 | | | 1 | | | | | | | | | 1 | | |
| 7 | | | | | | | | | | | | | | | | | | | 1 | 1 | 1 | 1 | | | 0 | | | | | | | | | 0 | | |
| 8 | | | | | | | | | | | | | | | 0 | | | 0 | 1 | 1 | 1 | 1 | | 1 | | | | | | | | | | | | |
| 9 | | | | | | | | | | | | | | | | | | 1 | 1 | 1 | 1 | 1 | | 0 | | | | | | | | | | | | |
| 10 | | | | | | | | | | | | | | | 1 | | | | 1 | 1 | 1 | 1 | | | | | | | | | | | 1 | | | |
| 11 | | | | | | | | | | | | | | | | | | | | | 0 | 1 | | | | | | | | | | | 0 | | | 0 |
| 12 | | | | | | | | | | | | | | | | | | | 0 | 0 | 0 | 0 | | | | | | | | | | | | | | 1 |
| 13 | | | | | | | | | | | | | | | 1 | | | | 0 | 0 | 0 | 0 | | | | | | | | | | 1 | | | | |
| 14 | | | | | | | | | | | | | | | | | | | | | 1 | 0 | | | | | | | | | | 0 | | | | |
| 15 | | | | | | | | | | | | | | | | 0 | | | | | 0 | 0 | | | | | | | | | | 1 | | | | |
| 16 | | | | | | | | | | | | | | | | | | | | | | | | | | | | | | | | | | | | |
| 17 | | | | | | | | | | | | | | | | | | 1 | 1 | 0 | 1 | 1 | | | | | | | | 0 | | | | | | |
| 18 | | | | | | | | | | | | | | | | 0 | | | | | 1 | 1 | | | | | | | | | 1 | | | | | |
| 19 | | | | | | | | | | | | | | | | | | | | | 0 | 0 | | | | | | | | | 0 | | | | | |
| SYNCHRONIZE 20 | | | | | | | | | | | | | | 1 | | | | | 1 | 0 | 1 | 0 | | | 0 | | | | | | | | | | | |

*Fig. 5*

IMPROVED MEMORY CONTROL FOR A SCANNING CRT VISUAL DISPLAY SYSTEM

BACKGROUND OF THE INVENTION

The present invention is related to the field of information readout systems, and more specifically to the field of scanning CRT (cathode ray tube) visual display systems which provide for information readout from a memory. The present invention has specific application to scanning CRT graphics display systems.

In known graphics display systems display information is received by a graphics display controller and formatted so as to produce a suitable visual display on a CRT display monitor. More particularly, the graphics display controller formats the information by providing a scanning dot matrix to produce a desired visual image due to the action of at least one scanning CRT gun, with the scanning of the gun across the CRT being reset in response to vertical and horizontal synchronization pulses and the video display being blanked during the reset of the scanning gun. Such scanning CRT displays are very well known and comprise standard CRT display monitors and television sets. To provide a color display, typically three primary color guns are used to simultaneously scan the CRT.

Typically the operation of the graphics display controller is performed in accordance with a received clock signal which determines the frequency of all of the operations performed by the controller. The controller is then programmed to produce the desired results, which may include storing formatted information signals in a refresh memory device and later addressing these stored signals for subsequent readout to the scanning CRT monitor.

In CRT display systems such as those described above, problems arise when it is necessary for the controller to fill the entire refresh memory with video information for subsequent readout. These problems arise because some controllers may not operate at a sufficiently rapid rate to complete the loading of the entire refresh memory within a short loading time period, especially if the time for loading the refresh memory is restricted to the time for blanking of the video display which blanking occurs during the reset of the CRT scanning gun. Typically it is desirable to load the refresh memory only during video blanking and thereby implement a so called "nonflash" mode since loading the refresh memory when the memory is being read out to the video display device may cause undesired flashing of the video image due to the attempted simultaneous read in and read out of video information with respect to the memory. The terms "read in" and "read into" as used herein are synonymous with the term "write" as it is commonly used to indicate the act of storing information in a memory device. This is also referred to herein as a "read mode". The problem of not having enough time for the controller to load the entire refresh memory essentially occurs because the controller is limited in that the maximum ratio of controller read in cycle time for the refresh memory to the controller read out cycle time is fixed, even though the actual times can be set in accordance with the received clock signal. Reading out of video information from the memory typically occurs during a display mode at a predetermined rate typically determined by the clock signal received by the controller, whereas this same clock signal also determines the read in cycle for loading information into the refresh memory and this read in cycle requires additional controller steps besides just addressing the refresh memory which is the only controller step typically required during the display mode.

In prior graphic video display systems such as those described above, four individual signal bits may be used to define each individual dot, such as three individual signal bits each defining the presence of one of three primary color hues which may be associated with the dot, as well as a signal bit defining an intensity characteristic for the dot. This means that these four signal bits which define each dot must be provided simultaneously to the display monitor means which will effectively channel these bits to three different primary color hue scanning electron guns and control the gun intensities. In such systems typically shift registers are utilized to receive predetermined groups of signal bits with each register associated with a dot characteristic such as each of the three primary color hues and an intensity characteristic. The loading of each of these shift registers with data corresponding to defining a number of dots is generally simultaneously performed by utilizing four separate memory devices each connected by an associated data bus to an associated one of these shift registers. Then the output data of the shift registers is sequentially shifted to sequentially define a number of dots. This loading technique for the registers requires a large number of separate data busses, each associated with one of the shift registers and memories, and this greatly increases the expense of such systems. In general terms, this same problem occurs whenever information must be read out of a memory device and provided to a number of different shift registers wherein all of the shift registers are intended to simultaneously provide individual output signal bits which together define a predetermined data word, corresponding to a dot in a scanning CRT system, wherein each of the shift registers has its output data shifted in accordance with a received clock signal so as to sequentially provide a number of such data words.

SUMMARY OF THE INVENTION

An object of the present invention is to provide an improved information read-out system which overcomes the above noted disadvantages.

A more particular object of the present invention is to provide an improved scanning CRT visual display system in which a standard display controller can rapidly load information into a memory device while providing for the controller to determine the read-out rate of the memory device at a rate suitable for reception by a scanning CRT display monitor.

An additional object of the present invention is to provide an improved graphic video display system, and/or an improved information read-out system, in which a memory device is coupled via only a single data bus to a plurality of shift registers wherein the shift registers will simultaneously provide for the proper read out of the information stored in the memory, even though the shift registers are sequentially loaded from the memory device.

In one embodiment of the present invention there is provided a scanning CRT visual display system. The scanning CRT visual display system comprises: means for providing information signals to be visually displayed on a CRT display monitor; controller means coupled to said information signal providing means for receiving said information signals and providing, during a read mode, address and formatted information signals in response thereto and providing address signals during a display mode, said signals being provided at a rate determined in accordance with the frequency of a received controller clock input signal, said controller means also providing video blanking output pulses and vertical and horizontal sync pulses which occur within the blanking pulses; clock means for providing a fixed frequency reference signal; clock control means coupled to said clock means for receiving said fixed frequency reference signal and selectively providing, in response thereto, said controller clock input signal to said controller means; memory means coupled to said controller means for receiving from said controller means said formatted information and address signals during said read mode and storing said formatted information signals at corresponding address locations in accordance with said received address signals, said memory means receiving address signals from said controller means during said display mode and in response to at least said address signals providing output display signals corresponding to said stored formatted information signals; and CRT display monitor means, including a scanning CRT, for receiving said output display signals from said memory means as well as receiving said video blanking pulses and said vertical and horizontal sync pulses from said controller means, and providing a corresponding visual display in accordance therewith; wherein the improvement comprises said clock control means providing said controller clock input signal with a first frequency during said display mode, and providing said controller clock input signal with a second, and substantially higher, frequency during said read mode, whereby the operation of said controller means is sped up during said read mode and said memory means is rapidly loaded by said controller means.

In accordance with the above stated feature of the present invention the operation of the controller means is effectively sped up during its read cycle when it stores information in the memory device, which preferably corresponds to a refresh memory comprising a dynamic random access memory (RAM). Preferably this speed up of the controller operation will occur during video blanking at which time a blanked video signal is provided by the CRT display monitor means and during which time the scanning guns in the CRT are repositioned by implementing a retrace function in response to received horizontal and vertical sync pulses. Preferably the controller is programmed such that it implements its read mode only during video blanking pulses so as to provide a "nonflash" mode for the entire display system.

According to another aspect of the present invention, an information read-out system is provided for simultaneously providing a plurality of different signal bits which together define a data word. This information read-out system comprises: electronic memory means for storing and later outputting output data signals, a plurality of said stored signals defining each data word; a plurality of N shift registers, each associated with a different data word bit; data bus means coupled between said memory means and each of said N shift registers; clock oscillator means coupled to each of said shift registers for providing data shift pulses; each of said N shift registers storing a sequence of data bits and each register simultaneously providing an independent data output signal bit for defining a bit of each data word, and each register shifting its data output in accordance with each received data shift pulse; means coupled to said N shift registers for receiving each group of said output signal bits simultaneously provided by said N registers which define said data word and utilizing said data word; and sequencer means for loading each of said N registers in a predetermined sequence from a common data bus which forms said data bus means, said common data bus coupled to each of said N shift registers and said memory means, and wherein each of said N shift registers has a different effective bit capacity, the difference in bit capacity between each of the shift registers sequentially loaded by said sequencer means being equal to at least the number of data shift pulses which occur between loading one of said shift registers and loading the next sequential one of said registers, whereby the output bits of all of said N shift registers are provided simultaneously to define each data word even though the information defining each data word is read sequentially into said shift registers.

The above recited aspect of the present invention is implemented in a graphics video display system in which each of the shift registers is associated with a different dot characteristic of a scanning CRT display with the difference in bit capacity between each of the sequentially loaded shift registers being equal to at least the number of dot pulses which occur between the sequential loading of the shift registers. The data word in such a system corresponds to a plurality of signal bits which together define a dot to be visually displayed. Preferably the loading of the shift registers occurs repetitively such that after loading all of the shift registers the process will continue by reloading the first shift register with additional information from the memory. When utilized in a graphics video display system, preferably three primary color shift registers are utilized, and a fourth shift register associated with the characteristic of dot intensity may also be utilized. The recited utilizing means then corresponds to a display monitor which uses each data word to produce a visual dot.

In accordance with an additional aspect of the present invention a graphics video display system is provided in which a sequencer is utilized to sequentially load N shift registers from a common data bus connecting the shift registers to a common memory. The sequencer provides address select signals to the memory for selecting different memory locations to be loaded into each of the shift registers, while also utilizing the same address select signals to effectively enable associated ones of the shift registers such that all of them will be sequentially loaded from the common data bus with the appropriate information stored in the addressed memory locations. This feature of the present invention assists in efficiently sequentially loading the registers and eliminating the need for many different data busses coupling separate memories to each of the N shift registers, while the previously mentioned feature that the shift registers have a different bit capacity ensures that even though the shift registers are sequentially loaded, their outputs will be simultaneously provided at the proper times so as to define each visual dot to be displayed.

Preferably the present invention is implemented by conventional programming of a standard graphic display controller, while utilizing an address latch circuit and programming of a programmable logic sequencer integrated circuit in accordance with the teachings of the present invention.

BRIEF DESCRIPTION OF THE DRAWINGS

For a more complete understanding of the present invention, reference should be made to the drawings in which:

FIG. 5 is a chart illustrating how to program a sequencer circuit in FIG. 1 to provide the signal waveforms in FIGS. 3 and 4.

DESCRIPTION OF THE PREFERRED EMBODIMENTS OF THE INVENTION

Figure 1:
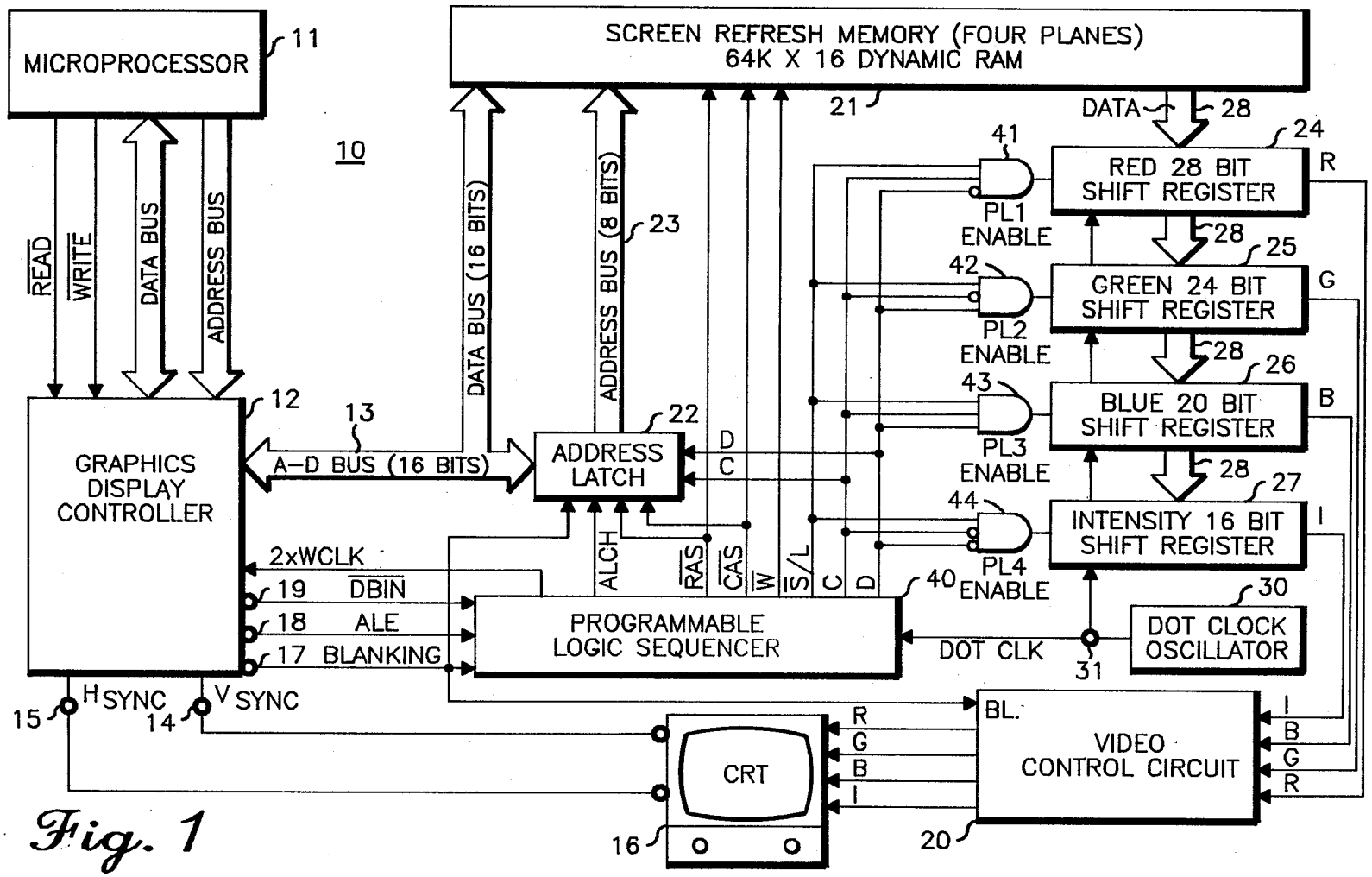
FIG. 1 illustrates a schematic diagram for a scanning CRT graphics video display system constructed in accordance with the present invention.

Referring to FIG. 1 a scanning CRT graphics video display system 10 is illustrated. Essentially a microprocessor 11 generates desired video information signals either by virtue of manual control input signals or received video information signals. The microprocessor also determines when the video signals currently being displayed, by virtue of these signals being stored in a memory device, no longer correspond to the signals which are desired to be displayed. In such an event the microprocessor will implement changing the video signals stored in the memory device. All of this is accomplished by virtue of the microprocessor 11 providing input information to a conventional graphics display controller 12 by virtue of the microprocessor being connected to the controller via a data bus, an address bus, and separate read and write control lines. The operation of the microprocessor 11 is not significant with respect to the novel aspects of the present invention and therefore will not be discussed in detail. The display system 10 essentially utilizes the microprocessor to determine when the signals in a memory device correspond to the signals which are desired to be displayed and when they do not. When the stored signals do not correspond to the signals desired to be displayed the microprocessor 11 will implement changes in these signals by virtue of the operation of the graphics display controller 12.

The graphics display controller 12 is a conventional graphics display controller and preferably corresponds to NEC graphics display controller PD7220 which is typically supplied as a 40 pin packaged integrated circuit. Essentially the graphics display controller 12 receives information signals from the microprocessor 11 and converts these into formatted information signals which are provided on a combined address-data (A-D) 16 bit bus 13. These formatted signals comprise data signals defining the display to be provided, and address signals indicating where the data signals should be stored. In addition, the controller 12 provides vertical and horizontal sync signals at associated terminals 14 and 15 which are coupled to corresponding input terminals on a conventional scanning CRT display monitor 16. The operating cycle of the graphics display monitor 12 is controlled in accordance with a received clock signal designated as the 2×W CLK signal. This clock signal essentially consists of pulses at a predetermined frequency wherein the operations of the controller are performed in accordance with the frequency of this received clock signal.

The controller 12, in addition to providing the vertical and horizontal sync signals, and the address and data information on the 16 bit bus 13, also provides a video blanking signal at a terminal 17, an address latch enable signal (ALE) at a terminal 18 and a display memory read input flag signal ($\overline{\text{DBIN}}$) at a terminal 19. The blanking signal occurs during the resetting of scanning CRT guns in the display monitor 16 and is coupled to a video control circuit 20 to ensure that no video information is provided to the CRT during the blanking interval. The address latch enable signal ALE at the terminal 18 indicates that the next information which will appear on the A-D bus 13 will be address information. Due to the known timing provided by the controller 12, at a predetermined time after this address information data information may be provided by the controller or received by the controller on the bus 13 if the controller is implementing a read-modify-write (RMW) mode of operation. The signal $\overline{\text{DBIN}}$ at the terminal 19 is utilized to indicate that writing of information by the controller 12 into a memory device can occur during the existence of a pulse created on this signal. Thus the signal DBIN is essentially utilized to derive a write pulse which allows a memory device to have the information provided by the controller 12 on the A-D bus 13 written into the memory device.

The operation of the graphics display controller 12, as discussed above, is conventional and is well described in literature associated with the NEC graphics display controller PD7220. Essentially the controller, in response to information signals provided by the microprocessor, formats these information signals to provide address and data information on the bus 13 while providing the signals at the terminals 14, 15 and 17–19. Typically the controller 12 is programmed to implement a "nonflash" mode in which, during video blanking, the RMW cycle is implemented. During this cycle the controller 12 will address certain locations containing information stored in a memory, read this information from the memory, allow the microprocessor to determine if this information should be changed, and then implement any such desired change by writing new information into the memory. The reading of information into the memory corresponds to a read mode of the controller 12. The controller 12 will also implement a display mode during the non video blanking times wherein the controller will address information stored in a memory device and provide for reading this information out to a plurality of shift registers each of which is associated with a different characteristic of visual dots to be provided by a graphics display system. The display system 10 of the present invention utilizes the graphics display controller 12, in conjunction with external circuitry, to provide an improved graphics display system. Of course the graphics display controller 12 must still be programmed by the user to provide the desired timing relationships for the signals which it generates, but this can be accomplished in a conventional manner whereas the present embodiment utilizes external circuitry to implement functions not normally provided by the graphics display controller.

The 16 bit address-data bus 13 is coupled directly to both a screen refresh memory 21, comprising a 64K by 16 dynamic RAM, and an address latch 22. The connection of the bus 13 to the refresh memory 21 essentially provides a 16 bit data input to the memory 21, while the connection of the bus 13 to the address latch 22 provides a 16 bit address input to the address latch 22. This dual use of the bus 13 is accomplished by additional signals which enable the memory 21 and address latch 22 at different times such that data is coupled between the controller 12 and the memory 21 via the bus 13 and address information is coupled between the controller 12 and the address latch 22 via the bus 13. This is more clearly explained in conjunction with the associated signal waveforms illustrated in FIGS. 3 and 4 which will be discussed subsequently.

The address latch 22 essentially implements a latching function for the 16 address bits it receives from the bus 13. It then, by virtue of multiplexing (strobing) techniques, sequentially provides 8 bits of address information at any one time to the refresh memory 21 by virtue of an 8 bit address bus 23 coupled between latch 22 and memory 21. This address information is utilized by the memory 21 to provide address locations for the data supplied to the memory via the 16 bit bus 13.

The memory 21 is contemplated as comprising a refresh memory which constantly needs to have its memory locations addressed in order to maintain stored data in its preexisting state. However, this feature of the memory 21 is not essential to operation of the present invention, and in fact this feature is conventionally accomplished by the normal operation of the graphics display controller 12.

Essentially the refresh memory 21 will store dot information in its memory and this information will be read out to a plurality of four shift registers each associated with a different dot characteristic. In the system 10 shown in FIG. 1, a red primary color shift register 24, a green primary color shift register 25, a blue primary color shift register 26 and an intensity shift register 27 are provided, and each of these shift registers is connected by a common 16 bit data bus 28 to the screen refresh memory 21. This is significant since typically in prior graphics display systems four separate data buses were utilized to connect four different memories to four shift registers each associated with one of the dot characteristics of red, green, blue and intensity. Thus the present invention contemplates reducing the total number of innerconnections required by having all of the shift registers 24–27 fed from a common data bus 28.

It should be noted that the screen refresh memory 21 will store individual dot data corresponding to each of the three primary color characteristics and an intensity characteristic. Thus any dot to be provided by the display system 10 will be defined by four signal bits, each bit associated with either one of the three primary color hues or the characteristic of intensity. The shift registers 24–27 will simultaneously read out data received from the screen refresh memory 21 to define each dot to be visually displayed and the manner in which this occurs will now be discussed.

The display system 10 includes a dot clock oscillator 30 which provides a fixed frequency signal comprising pulses, the occurrence of each pulse corresponding to the providing of a visual dot on the CRT display monitor 16 during non video blanking which occurs between the blanking pulses provided by the controller 12 at the terminal 17. The dot clock oscillator pulses are provided at an output terminal 31 which is connected as a common input to each of the shift registers 24–27. These shift registers operate in a conventional manner and respond to each dot clock pulse by shifting the output data of the shift register. It is a significant feature of the present invention that each of the shift registers 24–27 has a different bit capacity with the first shift register 24 having a 28 bit capacity, the shift register 25 having a 24 bit capacity, the shift register 26 having a 20 bit capacity and the shift register 27 having a 16 bit capacity. It is contemplated that after every four dot clock pulses, during non video blanking time which corresponds to a display mode, 16 bits of data from the memory 21 will be loaded simultaneously into one of the shift registers 24–27. The loading of each register will be sequential, with the sequence being repetitive with the first register 24 being loaded again after the last register 27.

At the time the information is loaded into the last shift register 27, 12 dot clock pulses have elapsed since 16 bits of information had been loaded into the first shift register 24. This will effectively implement delaying outputting the information read into the shift register 24 until the corresponding dot information is read into the shift register 27. The capacities of the shift registers 25 and 26 result in similar delays with the end result being that the shift registers 24–27 provide simultaneously a sequence of 16 bits of data which sequentially define 16 visual dots, in accordance with information which was stored in the memory 21, as output data is shifted out of the registers in accordance with the dot clock pulses. Thus initially data representing 16 dots with regard to their red characteristic is simultaneously read into register 24, then four dot pulses later corresponding information for these 16 dots related to their green characteristic is read into shift register 25, and so on. The use of different capacity shift registers is significant in that it allows the graphics display system 10 to sequentially load the shift registers 24–27, while permitting their simultaneous corresponding read out of stored dot information. This principal is applicable to any information read out system in which it is desired to sequentially load shift registers but have the shift registers provide for simultaneous corresponding read out of the data which was sequentially read into the shift registers.

It should be noted that at the time the shift register 27 is loaded, all of the registers 24–27 will commence simultaneously reading out four bits of data and this continues so as to sequentially define 16 dots. Since the loading of the registers is repetitive with register 24 loaded four dot pulses after register 27, after each register is initially loaded, this means that the register 24 must be loaded, the first time, 12 dot pulses prior to the actual providing of a visual display. This is no problem since this prior loading can take place during video blanking by merely having the control circuit 20 delay the resumption of video for 12 dot pulses after the termination of the blanking signal.

The use of shift registers in graphics display systems is known, but each of these shift registers, which is associated with a different dot characteristic, is typically simultaneously loaded from different data buses, and then the information in the shift registers is sequentially shifted and read out. This of course differs from the present embodiment which implements the sequential loading of the shift registers via a common data bus.

The single bit output data of each of the shift registers 24–27 is coupled as an input to the video control circuit 20 which also receives, as an input, the blanking signal provided at the terminal 17. In response to these signals the video control circuit 20 provides conventional red, green, blue and intensity control signals R,G,B,I to the scanning CRT display monitor 16 wherein it is understood that the primary color excitation signals R,G,B are directed to separate scanning primary color guns of the display station 16 and the intensity control signal I controls the intensity of the display provided on the CRT. The control circuit 20, as described herein, merely corresponds to a gate which blocks video signals (R,G,B,I) from the monitor 16 during video blanking.

The manner in which the screen refresh memory 21 is addressed by the controller 12 and the manner in which this addressing also results in the sequential loading of the shift registers 24–27 occurs by virtue of the operation of a programmable logic sequencer circuit 40 will now be discussed. The sequencer 40 comprises a bipolar field programmable logic sequencer which has been programmed to provide desired timing signals which are coupled to the controller 12, the address latch 22, the screen refresh memory 21 and the shift registers 24–27. Preferably the sequencer 40 comprises a Signetics 82S105 field programmable logic sequencer which has been programmed to implement the desired signal functions. Essentially the circuit 40 receives the dot clock signal at the terminal 31 and the controller 12 output signals $\overline{DBIN}$, ALE and blanking and provides the 2×W clock input signal to the controller 12, as well as various other timing signals. These signals result in addressing various locations in the refresh memory 21 and also sequentially enabling the shift registers 24–27 to allow for their sequential loading from the common data bus 28. In addition, these signals are contemplated as preferably increasing the frequency of the 2×W clock signal to the controller 12 during video blanking signals so as to speed up the operation of the controller 12 during its read-modify-write cycle which occurs during video blanking. This enables the controller 12 to more rapidly implement loading of the refresh memory 21, wherein this rapid loading is significant since the loading of the refresh memory must occur during the short retrace time of the scanning guns of the display monitor 16, and this retrace time is only a small percentage of the gun scanning which occurs during the providing of a visual display by the display station 16.

Essentially the programmable logic sequencer 40, in response to the input signals it receives, provides an address latch signal (ALCH) to the latch 22 and row address strobe signals ($\overline{RAS}$), as well as column address strobe signals ($\overline{CAS}$), to both the address latch 22 and the screen refresh memory 21. In addition, the sequencer 40 provides a write signal $\overline{W}$ to the refresh memory 21, and provides address select timing signals C and D to the address latch 22 and as effective inputs to four AND gates 41–44 which also receive a strobe latch signal $\overline{S}$/L during the display mode of the CRT display station 16. The timing signals C and D, and $\overline{S}$/L, are coupled to the AND gates 41–44 through various combinations of inverters, designated by inversion (not) terminals which precede the AND gates, so as to create a sequence of pulses provided by the AND gates 41–44 which pulses are connected to enable terminals of the shift registers 24–27 so as to load these shift registers in a predetermined sequence from the common data bus 28. It should be noted that the actual register enabling pulses are provided in accordance with the $\overline{S}$/L signal, with the signals C and D being utilized to ensure the proper sequencing of enabling of the shift registers 24–27. The manner in which different memory locations in the memory 21 are addressed by the signals provided by the programmable logic sequencer and how these signals also result in the sequential loading of the shift registers 24–27 and the speeding up of the frequency of the clock pulse signal 2×W received by the controller 12 will now be discussed in conjunction with FIGS. 2–4.

Figure 2:
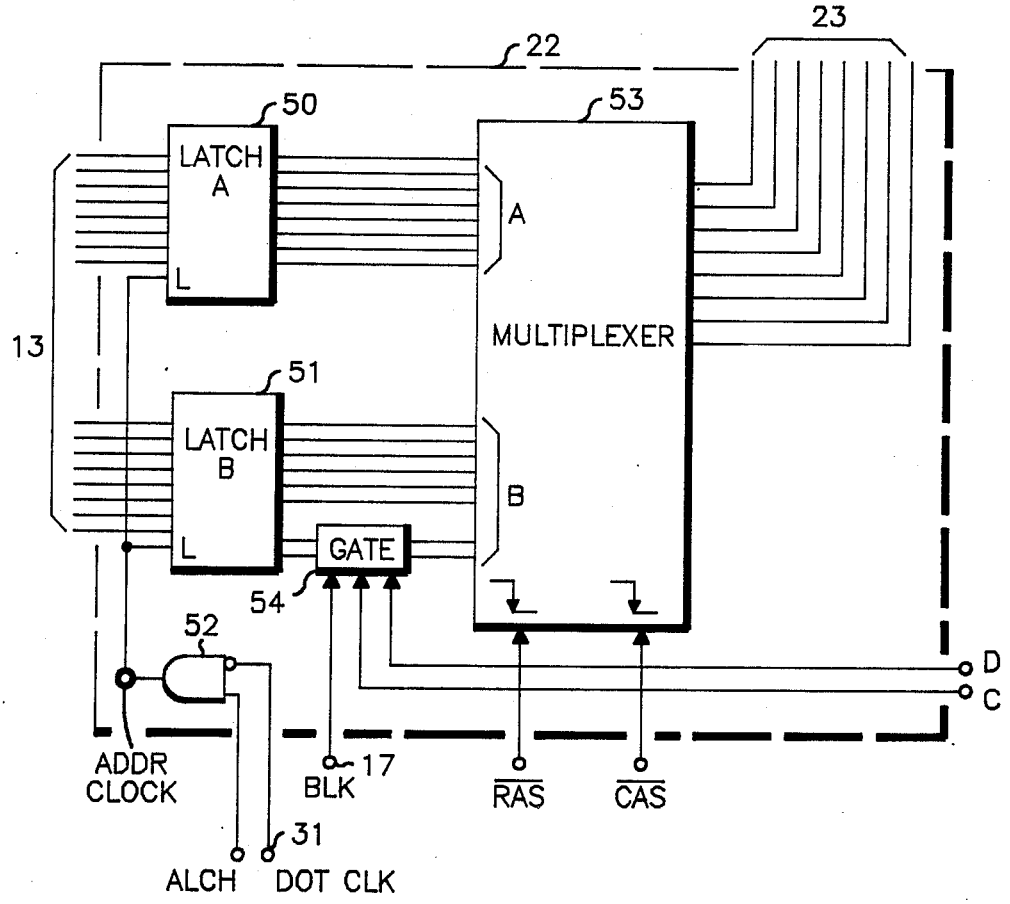
FIG. 2 is a schematic diagram illustrating the general configuration of an address latch utilized in the system shown in FIG. 1.

Referring to FIG. 2, a more detailed schematic diagram of a possible configuration for the address latch 22 is illustrated which shows that essentially the 16 bit data bus 13 is effectively grouped into two 8 bit data busses which are coupled to separate A and B latches 50 and 51. Each of the latches 50 and 51 has a latch terminal L which is connected to receive an address clock signal (ADDR. CLK) provided by an AND gate 52. The AND gate 52 has one input which receives the signal ALCH from sequencer 40 and another inverted input coupled to terminal 31 for receiving the dot clock pulses provided by oscillator 30. The connection between terminal 31 and latch 22 is not shown in FIG. 1 so as to maintain the clarity of that Figure. The latch 50 provides 8 latched output bits as A inputs to an effective multiplex circuit 53 that provides 8 bits of output which form the address bus 23. The latch 51 also provides 8 latched output bits, with the 6 least significant of these bits directly coupled as B inputs to the multiplex circuit 53, but the two most significant bits coupled as inputs to a gate circuit 54. The gate 54 also receives the address select signals C and D from the logic sequencer 40 as well as the blanking signal (BLK) provided by the controller 12. Two output bits of the gate 54 are coupled as B inputs to the multiplex circuit 53, which receives the signals $\overline{RAS}$ and $\overline{CAS}$ as control inputs.

Essentially the operation of the address latch 22 is to latch the 16 bits of address information provided on the bus 13 in response to the address clock pulse provided to the terminals L of the latches 50 and 51. Then the latches 50 and 51 have their outputs sequentially strobed (selected for readout) by the multiplex circuit 53 in accordance with the negative transistions of the signals $\overline{RAS}$ and $\overline{CAS}$. This permits utilizing only an 8 bit address bus 23 to the refresh memory 21 while still effectively providing a 16 bit address to the memory 21. This is because the signals $\overline{RAS}$ and $\overline{CAS}$ are also directly connected to the refresh memory 21 and provide a similar row and column strobing function for the memory 21. It should be noted that the providing of row and column address strobing functions to the refresh memory 21, by itself, is known and is conventionally utilized.

A feature of the present invention involves providing the gate 54 which will effectively, during a display mode, utilize the signals C and D as address select signals so as to effectively address four different planes of memory in the refresh memory 21, with each plane of memory associated with a different dot characteristic corresponding to any one of the three primary color hues or corresponding to intensity. This essentially implements a four page look-up for the screeen refresh memory 21. The present embodiment utilizes the signals C and D which implement the four page look up to also provide for the sequential loading of the shift registers 24–27 at the same time to ensure that each shift register is loaded with 16 bits of data located in the proper addressed associated plane of the memory 21. It should be noted that the gate 54 merely determines whether the latched two most significant bits of the latch 51 are to be directly provided as part of the 8 bit address bus 23, or whether the signals C or D are to be utilized as the two most significant bits of the B multiplex inputs. During a display (non blanking) mode a low blanking signal BLK is provided resulting in the use of the signals C and D, whereas during a read-modify-write cycle the specific address latched in the latch 51 and passes through the gate 54 to address, in conjunction with the output of latch 50, one specific memory location in the refresh memory 21 which is addressed by controller 12. Thus the gate 54 merely comprises selecting which one of two pairs of inputs will form the most significant bits of the B inputs to the multiplex circuit 53. The multiplex circuit 40 reacts to a negative transition of the $\overline{RAS}$ signal by selecting the A inputs as the signals provided on bus 23. In response to a negative transition of the signal $\overline{CAS}$, the B inputs are selected. Thus the multiplex circuit 53 operates substantially as a conventional multiplex circuit.

Figure 3:
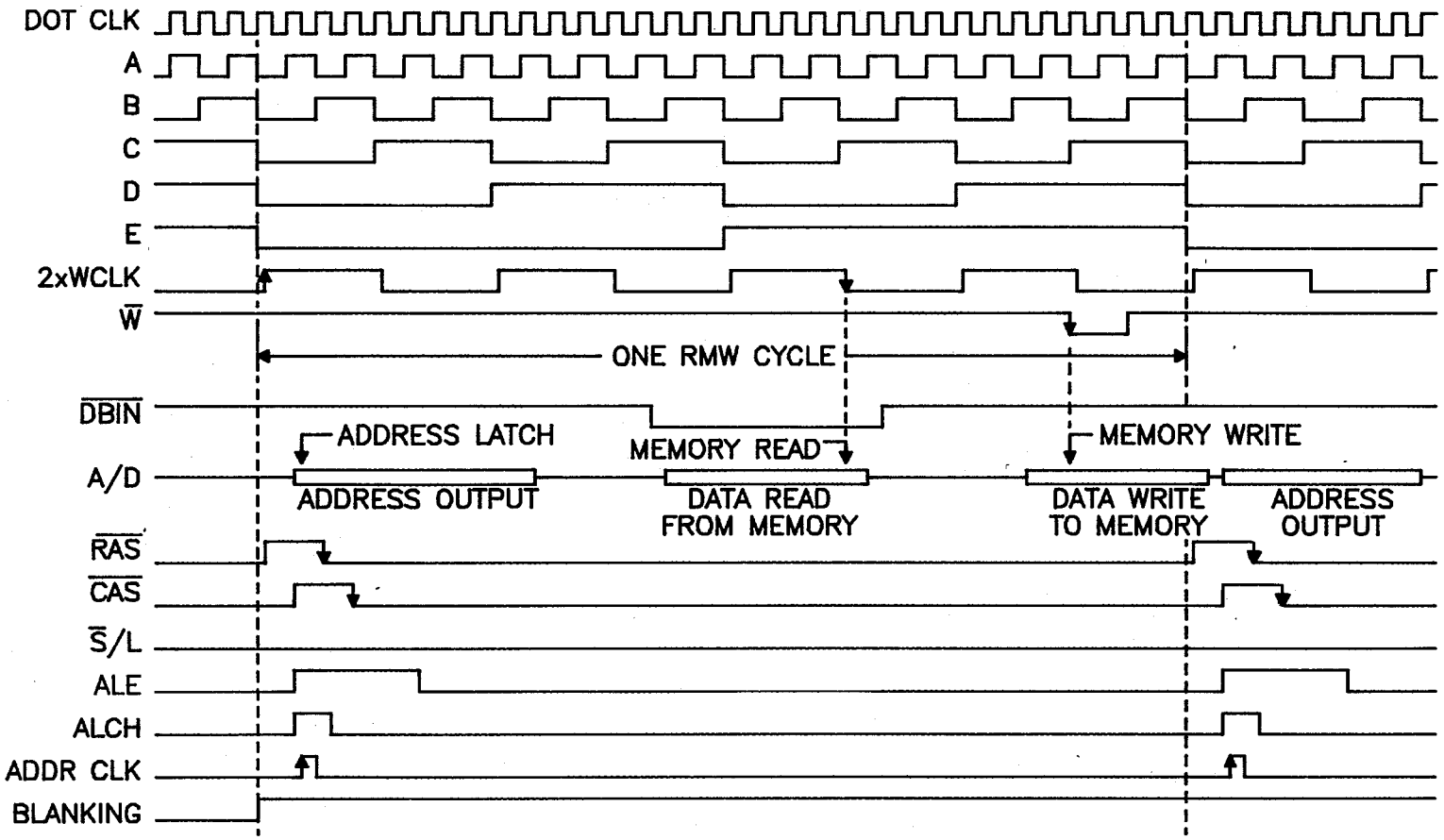
FIG. 3 comprises a series of graphs illustrating signal waveforms produced by the system shown in FIG. 1 during a read-modify-write (RMW) cycle during which information is loaded into a refresh memory.
Figure 4:
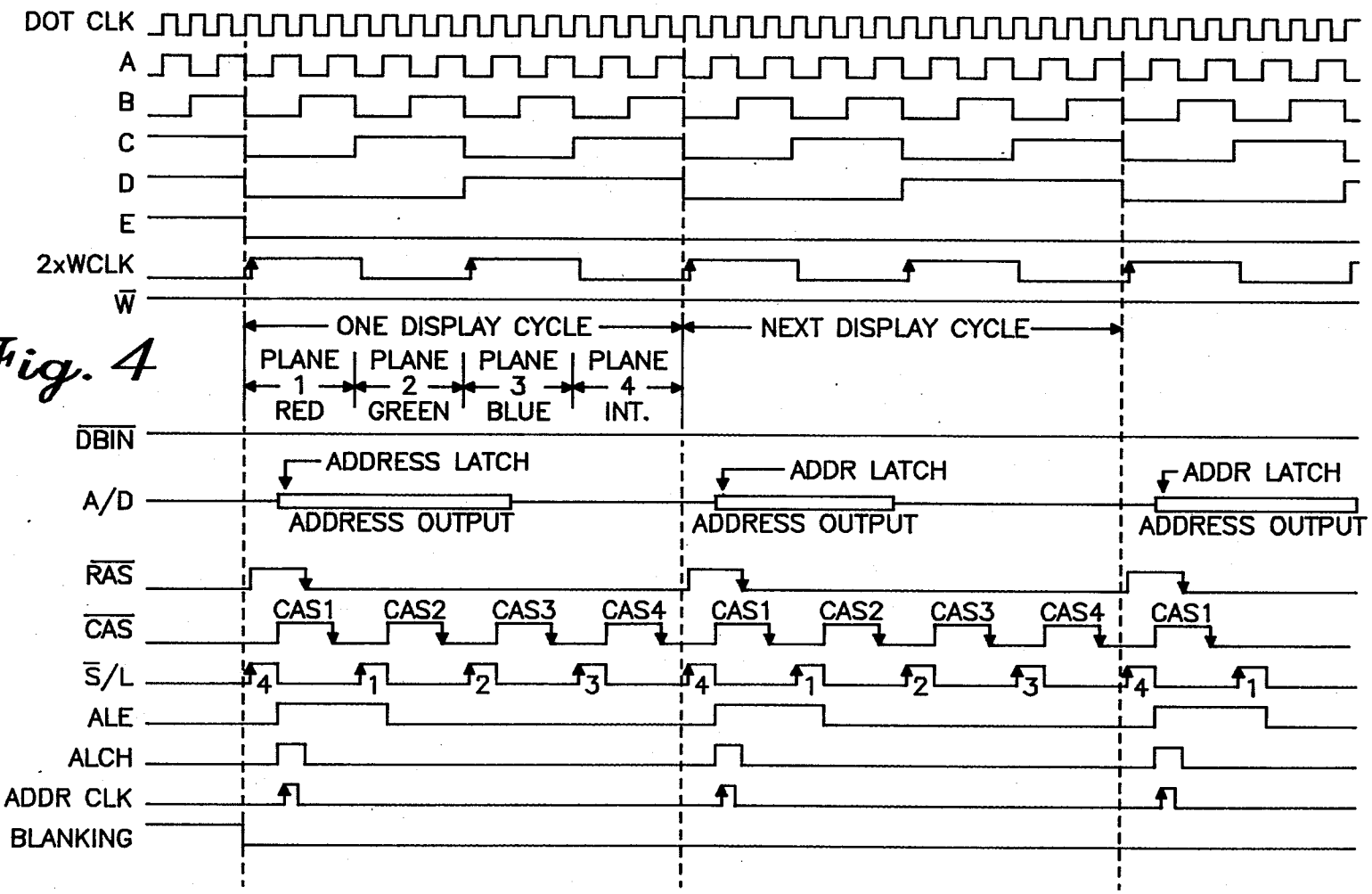
FIG. 4 is a series of graphs illustrating signal waveforms provided by the system shown in FIG. 1 during a display mode during which the information in the refresh memory is read-out and provided to a scanning CRT display monitor.

The operation of the display system 10 can best be understood by referring to the signal waveforms shown in FIGS. 3 and 4 taken in conjunction with the apparatus schematic diagrams illustrated in FIGS. 1 and 2. FIG. 3 essentially illustrates the signal waveforms produced by the system 10 during one read-modify-write cycle implemented by the graphics display controller 12 initiating a high video blanking signal BLK resulting in the blanking of all video to the CRT display station 16. It is contemplated, as is conventional, that the vertical and horizontal sync pulses will be produced during this video blanking high signal.

After the graphics display controller 12 initiates the high video blanking pulse, the controller 12 will then sequentially (a) output address information on the bus 13, (b) read data information provided from the refresh memory 21 on the bus 13, and then, if desired, (c) write additional new (modified) information into the memory 21 via the data bus 13. This cycle represents the read-modify-write (RMW) cycle of the controller, and it is contemplated that the controller is programmed, as is described in associated controller literature, so that this read-modify-write cycle (referred to herein as a read mode) will occur only during the occurrence of a high video blanking signal so as to implement a "nonflash" mode with regard to reading information into (writing information into) the refresh memory. The sequence of information provided on the address bus 13 during the RMW cycle is illustrated in FIG. 3. The controller 12 also conventionally will provide a low $\overline{DBIN}$ pulse during the RMW cycle at the time that information is to be read from the refresh memory 21, and of course this time will be subsequent to the providing of the address information by the controller 12. In addition, at an even later time in the RMW cycle the controller 12 will output information on bus 13 and read this information into the refresh memory in response to a write pulse ($\overline{W}$) if a low pulse on the $\overline{DBIN}$ signal had occurred, wherein this write pulse will occur during the read-modify-write cycle while the video blanking pulse is high indicating a nondisplay mode of operation for the display system 10. During a display mode information is read out of the memory 21, and during this mode the signal $\overline{DBIN}$ remains high.

Essentially the programmable logic sequencer 40 is programmed to use the dot clock oscillator signal at the terminal 31, and the controller signals BLK, ALE and $\overline{DBIN}$ provided at the terminals 17–19 to provide desired timing for all of the signals produced by the sequencer 40. In FIGS. 3 and 4, it is illustrated that the dot clock signal essentially comprises a high fixed frequency continuous series of pulses, each pulse corresponding to the occurrence of a visual dot during the display mode of the CRT 16. During a retrace mode for the guns of the CRT a predetermined number of these clock pulses will also exist. The logic sequencer 40 receives the dot clock signal and performs a series of frequency divisions by essentially merely counting the number of clock pulses. Thus, as shown in FIGS. 3 and 4, the dot clock signal first undergoes a frequency division of two resulting in the signal A and then this signal is counted and undergoes an additional frequency division of two resulting in the internal signal B. The signal B is divided again by a factor of two to provide the signal C, and this signal is divided by a factor of two to form the subsequent signal D. An internal signal E is also provided and during the read mode (the read-modify-write cycle) the signal E represents dividing the frequency of the signal D by a factor of two. Actually, the signal E remains low and effectively responds to the combination of the signal $\overline{DBIN}$ being low and the signal D having a high to low transition by being set high with signal E being reset low at the next signal D high to low transition. During a display mode, the signal $\overline{DBIN}$ never goes low so the signal E remains low.

All of the signals A–E can be conventionally provided by standard counter/divider and logic circuits and can be readily implemented. Preferably, as was previously noted, the programmable logic sequencer 40 corresponds to the Signetics 82S105 logic sequencer integrated circuit which has been fix programmed to provide these signals in accordance with the literature associated with this integrated circuit. It should be emphasized that once given the timing information illustrated in FIGS. 3 and 4 the programming of the logic sequencer 40 is relatively conventional since it involves working from a fixed input reference clock signal (the dot clock signal at the terminal 31) and providing specific signals and signal transitions in accordance therewith and in accordance with the other input signals provided by the programming of the controller 12. Preferably the Signetics 82S105 is programmed by using a Data I/0 Logic Pak TM 303A-004 input/output programming device which implements the programming table shown in FIG. 5 to provide the desired signals at the output pins of the Signetics circuit as indicated in FIG. 5.

The programmable logic sequencer 40 essentially utilizes the signal C obtained by dividing down the dot clock signal at the terminal 31, and inverts it to provide the $2\times W$ clock signal shown in both FIGS. 3 and 4. The $2\times W$ signal transitions occur slightly after the signal C transitions to indicate the existence of signal propagation delay provided by the sequencer 40. It should be noted that in FIGS. 3 and 4 the $2\times W$ clock signal is illustrated as having the same frequency during both the read-modify-write cycle and the display cycle. In the actual embodiment provided by the sequencer 40, this is the case. However, as was previously noted, preferably the present invention contemplates implementing a fast read-modify-write cycle for the controller 12. This can be accomplished by having the programmable logic sequencer 40 provide a $2\times W$ clock signal at 2 or 4 times the frequency of the $2\times W$ clock signal normally provided during the display cycle. If this were to be illustrated in FIG. 3, FIG. 3 would look identical with regard to the signal waveforms for the signals A–E, and the dot clock signal, but the repetition rate for the subsequent signals in FIG. 3 would be 2 or 4 times as great and the duration of pulses comprising these subsequent signals would be one half or one fourth. Since this would too greatly condense the drawing information, no such drawing has been illustrated. However, preferably a substantial increase in the frequency of the 2×W clock signal is contemplated during the read-modify-write cycle so as to enable the controller to rapidly write information into the refresh memory 21. The sequencer 40 can readily be programmed to implement this.

During the read-modify-write cycle, FIG. 3 illustrates that the programmable logic sequencer 40 will provide a row address strobe high pulse $\overline{RAS}$ to be followed by a subsequent column address strobe pulse $\overline{CAS}$. Prior to the controller 12 providing address information on the bus 13, the controller will provide an address latch enable signal ALE indicating that address information will now be provided on the bus 13 a short time after the AND pulse. At about this time the sequencer 40 will provide an address latch pulse ALCH, as shown in FIG. 3. During the coincidence of the pulse ALCH and a dot clock pulse an address clock signal pulse is provided by the AND gate 52 and this causes the address information on the bus 13 to be latched by the address latch 22. This is implemented by latching the address information into the two specific latches 50 and 51 which comprise the address latch 22. Subsequently, the row address strobe pulse $\overline{RAS}$ will have a negative transistion and this results in having the latch 50, via multiplexer 53, provide 8 bits of address information on the address bus 23 coupled to the refresh memory 21. This negative $\overline{RAS}$ transistion also results in the refresh memory 21 recognizing this as 8 address bits of a 16 bit address to be received. Subsequently a negative transistion is provided on the column address strobe pulse $\overline{CAS}$ which effectively results in the latch 51 now providing the address information for the bus 23, and the $\overline{CAS}$ pulse causes the refresh memory 21 to recognize the information on bus 23 as the remaining address information. This address information indicates to the refresh memory 21 where data should be stored or retrieved from. It should be noted that the significant transistions of the signals in FIGS. 3 and 4 are indicated by arrows in FIG. 3. Subsequently the graphics display controller 12 provides a low transistion for the display memory read input flag signal $\overline{DBIN}$. At a negative transistion of the 2×W clock signal during the low pulse of signal $\overline{DBIN}$ data is read from the refresh memory 21 to the controller 12, and then on to the microprocessor 11. During a subsequent time the microprocessor determines if modification of this data is necessary, and if so provides such information to the graphics display controller. Subsequently the controller 12 provides data write information to the memory 21 on the data bus 13, and at a negative transistion of the write signal $\overline{W}$ this information is written into the memory 21. The data on bus 13 persists for a short time after the read-modify-write cycle, but this represents no problem since the subsequent address information will not occur until some subsequent time. This is also in accordance with the normal operation of the graphics display controller 12.

From the above discussion it can be seen that the $\overline{RAS}$ and $\overline{CAS}$ signals are merely utilized to latch and strobe latched address information into the refresh memory 21 so as to effectively create a 16 bit address for data to be supplied on the bus 13. In a color graphic system four planes of such data are required, and the present system requires a separate read-memory-write cycle to address any one of these planes. However, during the display cycle each of the four planes of address memory will be selectively addressed by virtue of the signals C and D forming part of the most significant latched address information provided by the latch 51. This can be illustrated by referring to FIG. 4 which illustrates two display cycles.

In FIG. 4, the dot clock signal and the signals A, B, C, D, E and the 2×W clock signal are shown having the identical time scale as shown in FIG. 3. Since a display cycle, rather than a read-modify-write cycle, is shown in FIG. 4, there will be no negative $\overline{W}$ signal pulse, and this is readily implemented by having the sequencer 40 provide this pulse in accordance with whether or not a high video blanking signal is currently provided by controller 12. In FIG. 4 a low blanking signal is provided during the display cycle indicating that video information is provided to the CRT display station 16 by the control circuit 20. The remaining waveforms in FIG. 4 illustrate how this video information is provided in accordance with the initial address information provided by the controller 12 and supplemental address select signals provided by the sequencer 40.

In FIG. 4, the logic sequencer 40 again produces $\overline{RAS}$ and $\overline{CAS}$ pulses, and subsequently the controller 12 produces an address latch enable pulse ALE indicating that address information will be provided on the bus 13 shortly thereafter. The logic sequencer 40 produces a positive pulse ALCH which together with a dot clock pulse produce the address clock signal ADDR. CLK. This results in latching the 16 bits of address information on bus 13 by virtue of the latches 50 and 51 in the address latch 22. In response to the negative transistions of the $\overline{RAS}$ and $\overline{CAS}$ signals the latches 50 and 51 have their strobed outputs provided as input determining signals for the bus 23. During a display cycle, as distinguished from the read-modify-write cycle, during the negative transistion of the signal $\overline{CAS}$, the gate 52 will now provide the signals C and D as the most significant bits of the latch 51 address information provided on the address bus 23. This results in the signals C and D effectively selecting the address of the refresh memory 21 which will be read out and stored in the shift registers 24–27.

As can be seen in FIG. 4, the controller 12 does not provide any additional $\overline{RAS}$ signal during one display cycle, but all four planes of dot characteristics are addressed by the display system 10. This occurs because the programmable logic sequencer 40, during each display (non-blanking) cycle will provide additional $\overline{CAS}$ pulses CAS2, CAS3 and CAS4 as shown in FIG. 4 in addition to the CAS1 pulse which overlaps the $\overline{RAS}$ pulse. This results in providing different address information to the refresh memory 21 for each negative transition of the pulses CAS2–CAS4 since the states of the signals C and D will differ for each of these negative $\overline{CAS}$ transitions. It should be noted that the row address information received by the memory 21 persists between $\overline{RAS}$ pulses and this is conventional for dynamic refresh memories addressed by relatively rapidly occurring pulses.

Providing the four CAS pulses per display cycle effectively results in a page read-out mode for the refresh memory 21 whereby four sets of 16 bit data fully defining four different characteristics of 16 dots will be sequentially read-out of the refresh memory 21. This is accomplished without any extensive reprogramming of the controller 12 since it occurs by virtue of the programmable logic sequencer 40 merely producing additional $\overline{CAS}$ pulses during a non-blanking-display mode of operation. Programming the sequencer 40 to produce such a result can be readily achieved given the fact that the sequencer can generate any desired pulses with respect to the timing relationships provided by the dot clock, and given the fact that during a high state of the input blanking signal BLK one $\overline{CAS}$ signal is to be produced during the read-modify-write signal whereas during a display cycle four such pulses are to be produced.

FIG. 4 also illustrates that during each display cycle four load pulses are provided for the signal $\overline{S}/L$ wherein essentially four dot clock pulses occur between each of these pulses. The pulses of the signal $\overline{S}/L$ are utilized in conjunction with the address select timing signals C and D to sequentially enable the shift registers 24–27 by virtue of the AND gates 41–44. Thus the present invention has provided for the address select signals C and D not only selecting different planes of memory for retrieving dot information stored in the refresh memory 21, but has also utilized these same signals to provide for the sequential loading of the shift registers 24–27 at the time the corresponding dot information is provided on the common bus 28 for the memory plane (page) being addressed. It should be noted that in FIG. 4 the $\overline{S}/L$ pulse 1 after the negative transition of CAS1 loads the register 24, with the $\overline{S}/L$ pulses 2–4 then sequentially loading registers 25–27, respectively.

It can be seen that in FIG. 4 the graphics display controller 12 will output address information more frequently during each display cycle than it had during each read-modify-write cycle. But this is a normal operation of the controller 12 since the controller recognizes that for merely reading out information from the refresh memory 21 a faster cycle can be implemented because during the read-modify-write cycle the controller must read data from the memory 21 back on the bus 13, compare this data to desired data determined by signals from the microprocessor, modify the data if necessary, and then write the data back to the refresh memory 21. Thus the controller recognizes that each read-modify-write cycle must take an appreciable amount of additional time. However, as contemplated by the present invention, this time can be shortened by having the programmable logic sequencer 40 increase the frequency of the $2\times W$ clock signal which controls the timing of the controller 12 during the video blanking cycle.

It should be noted that having the programmable logic sequencer 40 synchronize its output signals with signals generated by the controller 12 is necessary to avoid having the $\overline{RAS}$ and $\overline{CAS}$ signals provided by the logic sequencer occur at the wrong times. In order to accomplish this synchronization, it was noted that such synchronization could be achieved by noting when the ALE signal went high and the signal A had a logic state of 0, the signal B had a logic state of 1, the signal C had a logic state of 0 and the signal D has a logic state of 1. In this event proper synchronization of all the signals provided by the programmable logic sequencer 40 can be achieved by resetting the logic state of the signal D to 0. If this condition does not occur then resetting of signals provided by the sequencer 40 is not needed in order to ensure proper operation. The above synchronization scheme will ensure the proper creation of the timing signals produced by the programmable logic sequencer 40.

While specific embodiments of the present invention have been shown and described, further modifications and improvements will occur to those skilled in the art. All such modifications which retain the basic underlying principals disclosed and claimed herein are within the scope of this invention.

We claim:

1. A scanning CRT visual display system comprising:

means for providing information signals to be visually displayed on a CRT display monitor;

controller means coupled to said information signal providing means for receiving said information signals and providing, during a read mode, address and formatted information signals in response thereto and providing address signals during a display mode, said signals being provided at a rate determined in accordance with the frequency of a received controller clock input signal, said controller means also providing video blanking output pulses and vertical and horizontal sync pulses which occur within the blanking pulses;

clock means for providing a fixed frequency reference signal;

clock control means coupled to said clock means for receiving said fixed frequency reference signal and selectively providing, in response thereto, said controller clock input signal to said controller means;

memory means coupled to said controller means for receiving from said controller means said formatted information and address signals during said read mode and storing said formatted information signals at corresponding address locations in accordance with said received address signals, said memory means receiving address signals from said controller means during said display mode and in response to at least said address signals providing output display signals corresponding to said stored formatted information signals; and CRT display monitor means, including a scanning CRT, for receiving said output display signals from said memory means, as well as receiving said video blanking pulses and said vertical and horizontal sync pulses from said controller means, and providing a corresponding visual display in accordance therewith;

wherein the improvement comprises said clock control means providing said controller clock input signal with a first frequency during said display mode, and providing said controller clock input signal with a second, and sustantially higher, frequency during said read mode, whereby the operation of said controller means is sped up during said read mode and said memory means is rapidly loaded by said controller means.

2. A scanning CRT visual display system according to claim 1 wherein during said blanking pulses and in response to said sync signals the scanning CRT of the CRT display monitor means implements a retrace function to re-initialize the position of at least one scanning gun of the CRT, while at times other than during said blanking pulses the scanning gun sweeps across a surface of the CRT to provide a visual line display in accordance with said output display signals received from the memory means.

3. A scanning CRT visual display system according to claim 2 wherein said controller means implements said read mode during said video blanking pulses so that said formatted information signals are not read into the memory means at the same time that said output display signals are being read out of the memory means.

4. A scanning CRT visual display system according to claim 1 wherein said controller means implements said read mode during said video blanking pulses so that said formatted information signals are not read into the memory means at the same time that said output display signals are being read out of the memory means.

5. A scanning CRT visual display system according to claim 1 wherein said clock control means provides said second higher frequency clock signal to said controller in response to receiving and during said blanking pulses provided by said controller means.

6. A scanning CRT visual display system according to claim 1 wherein no visual display is provided by said CRT monitor means in accordance with said information signals during said blanking pulses.

7. A graphics video display system comprising:

electronic memory means for storing and later outputting dot output data signals, a plurality of said stored signals defining each dot to be visually displayed;

a plurality of N shift registers, each associated with a different dot characteristic;

data bus means coupled between said memory means and each of said N shift registers;

dot clock oscillator means coupled to each of said shift registers for providing dot pulses corresponding in time to each dot to be visually displayed;

each of said N shift registers storing a sequence of dot data and simultaneously providing an independent data output signal bit for defining a characteristic of each dot, and each register shifting its data output in accordance with each received dot clock pulse;

display means coupled to said N shift registers for receiving each group of said dot output signal bits simultaneously provided by said N registers and defining a visual dot in accordance therewith; and sequencer means for loading each of said N registers in a predetermined sequence from a common data bus which forms said data bus means, said common data bus coupled to each of said N shift registers and said memory means, wherein each of said N shift registers has a different effective bit capacity, the difference in bit capacity between each of the shift registers sequentially loaded by said sequencer means being equal to at least the number of dot pulses which occur between loading one of said shift registers and loading the next sequential one of said registers, whereby the output bits of all of said N shift registers are provided simultaneously to define each dot even though the information defining each dot is read sequentially into said shift registers.

8. A graphics video display system according to claim 7 wherein at least 3 of said shift registers are provided, each associated with a different dot color hue.

9. A graphics video display system according to claim 8 wherein a 4th one of said shift registers is provided associated with the characteristic of dot intensity.

10. A graphics video display system according to claim 7 wherein said sequencer means includes means for providing address select signals to select N different input addresses for said memory means while also utilizing said address select signals to select predetermined associated ones of said N shift registers into which said addressed data from said memory means is to be loaded.

11. A graphics video display system according to claim 10 wherein said sequencer means repetitively reimplements said sequential loading of said N shift registers from said memory means after each sequential loading cycle of all of said N shift registers.

12. A graphics video display system according to claim 7 wherein said sequencer means repetitively reimplements said sequential loading of said N shift registers from said memory means after each sequential loading cycle of all of said N shift registers.

13. A graphics video display system comprising:

electronic memory means for storing and later outputting dot output data signals, a plurality of said stored signals defining each dot to be visually displayed;

a plurality of N shift registers, each associated with a different dot characteristic;

data bus means coupled between said memory means and each of said N shift registers;

dot clock oscillator means coupled to each of said shift registers for providing dot pulses corresponding to each dot to be visually displayed;

each of said N shift registers storing a sequence of dot data and simultaneously providing an independent data output signal bit for defining a characteristic of each dot, and each register shifting its data output in accordance with each received dot clock pulse;

display means coupled to said N shift registers for receiving each group of said dot output bits simultaneously provided by said N registers and defining a visual dot in accordance therewith; and sequencer means for loading each of said N registers in a predetermined sequence from a common data bus, which forms said data bus means, said common data bus coupled to each of said N shift registers and said memory means, and wherein said sequencer means includes means for providing address select signals to select N different input addresses for said memory means while also utilizing said address select signals to select predetermined associated ones of said N shift registers into which said addressed data from said memory means is to be loaded.

14. A graphics display system according to claim 13 wherein said sequencer means and said N shift registers provide the output bits of all of said N shift registers simultaneously to define each dot even though the information defining each dot is read sequentially into said shift registers from said memory means.

15. A graphics video display system according to claim 14 wherein at least 3 of said shift registers are provided, each associated with a different dot color hue.

16. A graphics video display system according to claim 15 wherein a 4th one of said shift registers is provided associated with the characteristic of dot intensity.

17. An information read out system for simultaneously providing a plurality of different signal bits which together define a data word, comprising:

electronic memory means for storing and later outputting output data signals, a plurality of said stored signals defining each data word;

a plurality of N shift registers, each associated with a different data word bit;

data bus means coupled between said memory means and each of said N shift registers;

clock oscillator means coupled to each of said shift registers for providing data shift pulses;

each of said N shift registers storing a sequence of data bits and each register simultaneously providing an independent data output signal bit for defining a bit of each data word, and each register shifting its data output in accordance with each received data shift pulse;

means coupled to said N shift registers for receiving each group of said output signal bits simultaneously provided by said N registers which define said data word and utilizing said data word; and sequencer means for loading each of said N registers in a predetermined sequence from a common data bus which forms said data bus means, said common data bus coupled to each of said N shift registers and said memory means, wherein each of said N shift registers has a different effective bit capacity, the difference in bit capacity between each of the shift registers sequentially loaded by said sequencer means being equal to at least the number of data shift pulses which occur between loading one of said shift registers and loading the next sequential one of said registers, whereby the output bits of all of said N shift registers are provided simultaneously to define each data word even though the information defining each data word is read sequentially into said shift registers.

18. An information read out system according to claim 17 wherein said sequencer means includes means for providing address select signals to select N different input addresses for said memory means while also utilizing said address select signals to select predetermined associated ones of said N shift registers into which said addressed data from said memory means is to be loaded.

19. An information read out system according to claim 18 wherein said sequencer means repetitively reimplements said sequential loading of said N shift registers from said memory means after each sequential loading cycle of all of said N shift registers.

20. An information read out system according to claim 17 wherein said sequencer means repetitively reimplements said sequential loading of said N shift registers from said memory means after each sequential loading cycle of all of said N shift registers.

* * * * *